United States Patent [19]

Vasquez

[11] 4,428,307

[45] Jan. 31, 1984

[54] SAFETY CASH BOX

[76] Inventor: Tulio Vásquez, Carrera 15 No. 39-27, Bogotá, Colo.

[21] Appl. No.: 317,145

[22] Filed: Oct. 30, 1981

[51] Int. Cl.[3] ..... E05G 1/04; A47B 88/00

[52] U.S. Cl. ..... 109/45; 312/333; 235/130 R

[58] Field of Search ..... 232/1 D, 4 D, 6, 16; 109/45, 53; 70/85; 235/22, 91 A, 100, 130 R, 131 JA; 312/333

[56] References Cited

U.S. PATENT DOCUMENTS

| | | | |
|---|---|---|---|
| 2,145,314 | 1/1939 | Murtaugh, Jr. | 70/85 |
| 3,851,942 | 12/1974 | Clay et al. | 312/333 |
| 4,066,308 | 1/1978 | Wedel | 312/333 |
| 4,182,539 | 1/1980 | Busch | 235/22 X |
| 4,341,166 | 7/1982 | Cantley | 312/333 X |

*Primary Examiner*—Robert P. Swiatek
*Attorney, Agent, or Firm*—Browdy and Neimark

[57] ABSTRACT

A safety cash box includes a housing body and a slide drawer which can be moved back and forth within the housing. The drawer can be brought into a retracted, irreversibly locked and further jammed condition when, at the occurrence of disturbing conditions, an outer pushbutton is pressed or when a remotely generated electrical signal is applied to act on an electromagnetic triggering device arranged in the safety cash box. Thus, the safety cash box according to the invention comprises first, a mechanical arrangement intended to keep the slide drawer firmly in a locked position prevented from being shifted forward and, secondly, a backup security assembly which, when actuated, causes the drawer to become forcefully wedged in place in response to mechanical failure brought about on the locking arrangement. To this end, the shearing strength of the locking device is predetermined to correspond with a breaking down point, which when exceeded by a shearing stress so applied as to have the drawer dislodged, actuates the jamming mechanism.

4 Claims, 3 Drawing Figures

SAFETY CASH BOX

BACKGROUND OF THE INVENTION

Cash registers are known wherein a drawer is ejected from the safe-compartment when a set of circumstances have been met. A sound signal is concomitantly generated each time the drawer is ejected.

SUMMARY OF THE INVENTION

The invention relates to a safety cash box suitable for keeping and handling money such as in commercial and business premises, and in particular to cash boxes having mechanical and electrical devices which operate in order to allow the money and the like to remain protected if an emergency state requiring immediate action, such as a holdup or theft case or the like, should occur. To this end, the cashier can manually act on accessible mechanical means or the safety cash box may be subjected to an electrical signal originating from a remote location to thereby energize an electromagnetic trigger device. In either case, with the safety cash box slide drawer being either at an extended or a retracted position, the trigger device operates to automatically move the drawer to reach a retracted, irreversibily locked condition within the safety-box housing where it is kept firmly locked, and where it becomes forcefully jammed if substantial effort, tending to break the slide drawer open, is exerted.

The present invention comprises spring-winding motive system including a first rear spring-wound drive and a second front spring-wound drive, with said rear spring-wound drive having a tractive force greater than the spring tension or torque exerted by said front spring-wound drive, and a driving belt connecting both the spring-wound drives together. The driving belt is held under tension, and for the length of the safety cash box normal use it is stabilized by an idler pulley which in turn is held rigid by means of a pawl and ratchet-wheel arrangement to which the idler pulley is connected. The belt connecting both of the spring-wound drive mechanisms together has a drag block fixedly mounted thereon at a point along its length. In operation, when the pawl and ratchet-wheel mechanism is activated so as to release its associated idler pulley, the balancing effect or braking action on the system's drive belt ceases, whereby the spring-winding motive system is triggered. As a result, the rearwardly located spring-wound drive, which has the greater pull, draws the drive belt backward along with the drag block which is fixedly mounted thereon. The drag block is then moved to engage thrust means provided in the slide drawer to thereby bring it back into its housing. When the drag block is thus moved, the following takes place:

(a) A bearing plate or abutment lug attached to a pivoting shaft bearing two spaced-apart ratchets is freed for meshing engagement with respective rack bars. The rack bars are parallel and extend longitudinally of the slide drawer, and rigidly joined to the underside of the front section of the bottom of the slide drawer. With this arrangement, when the ratchets and the respective rack bars are in meshing relationship the shiftable drawer is locked and prevented from being moved forward.

(b) In its backward travel the drag block collides against a thrust-supporting abutment fixedly extending beneath the shiftable drawer so that, as a result, the drawer is moved to its wholly retracted position, regardless the position it should originally have at the time when the hasty closing operation was started.

The pawl associated with the ratchet-wheel device locking the idler pulley which in turn engages the driving belt, can be shifted out of its engaged position in one of two ways:

(a) An exposed push-button which may be pushed through a connecting rod operates to shift the ratchet-wheel pawl out of its locking engagement to release the ratchet wheel, or (b) by magnetic attraction, an electromagnet may act on a pawl of magnetic material arranged as its armature, to take the pawl away from its engaged position. The electromagnet allows the drawer's motive system to be triggered from a remote location whereby the safety cash box may be brought into an irreversibly locked condition.

In addition to the drawer locking mechanism, it is another object of this invention to provide the safety cash box with a forcible jamming arrangement purposely designed to be mechanically stronger than the drawer locking mechanism.

The shiftable drawer comprises a rear section and a front section assembled together. The rear section is a member formed by a single-walled bottom and single side walls, whereas the front section has both bottom and side walls made each of double-panel construction, with the pair of panels forming each of the walls being spaced apart to define a void therebetween. The void so formed is sized to snugly hold the marginal leading edges of the single panels forming the drawer rear-section walls. Thus, the shiftable drawer is formed by nesting the single-panel bottom and side walls of the drawer rear section into the spaces provided by the respective double-panel bottom and side walls of the drawer front section, with the two sections thus assembled being held firmly together by means of a rivet joint. It is purposely provided that the connecting rivet(s) used here, be designed as safety pin(s) having a specified maximum shearing strength for a purpose to be described later. For the moment, it suffices to mention here that the rivet joint between the shiftable drawer's two sections is designed to withstand use of the drawer under normal conditions. The rivets used are however liable to fail, and their breakage will occur when a lengthwise applied shearing stress tending to detach the drawer sections from each other—such as in the case of a force exerted on the locked drawer to break it open—exceeds the maximum calculated shearing strength of the connecting rivets. As the rivets yield, the rear section will, to a certain extent, telescopically be moved with respect to its associated front section.

The jamming device comprises top and bottom rack bars firmly affixed lengthwise inside the housing body, and vertically oriented bolt mechanisms fixedly attached to the housing body inner sidewalls so that each one of a pair of bolts can vertically be shifted into engagement with each of the respective top and bottom rack bars. The bolts preferably are round-headed bolts installed so that their shanks are vertically movable in tight, but sliding, engagement through guide collars. Further, a double-wedge block is firmly attached laterally in each of the double side walls of the slide-drawer front section, the installation being such that the block protrudes outside the respective side walls on which it is mounted, and is located behind the vertical axis of the bolt mechanism. The double-wedge blocks are identical, and each has the form of a generally trapezoidal block arranged so that one of its slanting surfaces is directed upward and the other is directed downward, with its major base being rearward directed, and being disposed vertically in the same vertical plane containine each set of bolts and one lateral set of horizontal top and bottom rack bars, so that a wedge-and-bolt sliding contact is established with the rack bars in order to vertically shift the bolts when the double-wedge blocks are caused to travel forwardly.

Accordingly, by virtue of the high-strength bolt mechanisms placed on each inner face of the housing sidewalls and by virtue of the respective double-wedge block fixedly joined to the slide-drawer front section which laterally protrudes through a respective cutaway section or window provided in the respective side wall of the slide-drawer section, when the drawer front section is shifted forwardly, even though only through a short length, the double-wedge blocks act to axially shift the bolts respectively upward and downward, whereby they engage with the respective top and bottom high-strength rack bars, so that the drawer becomes wholly blocked. Since the double-wedge blocks are widened at their base, upon striking against the bolt guide sleeves, the widened sections become further wedged between said sleeves.

It is a further object to provide a restoring device which allows the drawer, once open, to be brought into an irreversibly locked condition. The restoring mechanisms consist of a striker rod which, when pressed, removes the ratchets from their respective associated rack bars thus permitting the drawer to move out of its housing. This in turn resets the spring-wound drives to their original, loaded condition. In order to reach the restoring striker, it is necessary to remove a safety front plate which is held in place by a number of screws and/or locking pins. This is a time consuming operation requiring in addition special tooling.

The present invention also provides for a push lock to keep the drawer under lock and key. By means of a specially arranged inner plate, the lock is prevented from being tampered with while the drawer is still extended, which otherwise would impair the drawer automatic closing.

The special arrangement of the ratchets and racks permits a check of the performance of the mechanism which triggers the automatic closing of the drawer, without the need to take apart the safety plate, because the rear ends of the racks fixedly joined to the slide-drawer rear section have no teeth. In this manner, when the drawer is fully extended outwardly, and while the operator manually holds the drawer handle and at the same time acts on its pushbutton to trigger its automatic-closing motive means, he then may sense the pull—or its absence—tending to urge the drawer backward.

BRIEF DESCRIPTION OF THE DRAWINGS

An embodiment of the invention will be described in detail in connection with the accompanying drawings, in which.

DESCRIPTION OF THE PREFERRED EMBODIMENT

Figure 3:
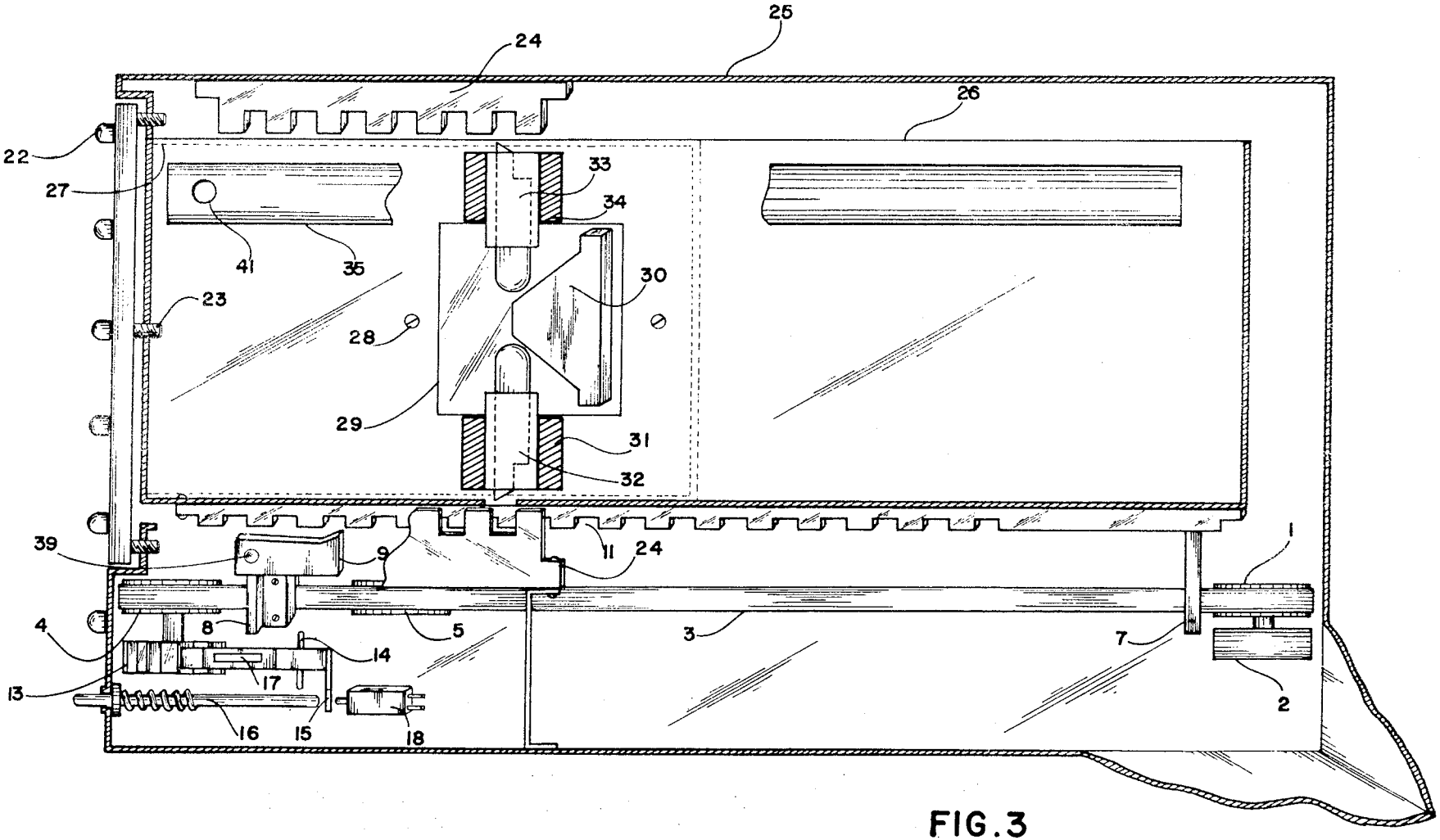
FIG. 3 is a sectional elevation view taken along the safety cash box with its sliding drawer retracted within the housing.

Turning now to the drawings, the safety cash box comprises a main housing body 25 including respective upright sidewalls and respective, planar, spaced apart top and bottom walls, which housing body slidably supports a slide drawer that includes a rear section 26 and a front section 27 (FIG. 3).

Spanning the inner lower part of the body 25 beneath the combined slide drawer 26, 27 is a belt 3 having its ends wound around the spools of spring-wound drives 1 and 5, the latter being tensioned and held tight by the idler pulley 4. The rear spring-wound drive 1 exerts the net tractive effect and its purpose is to shift rearwardly the drag block 6 mounted on the belt 3, when the idler pulley 4 is set free, upon disengagement of the pawl 14 from its associated rack wheel 13. The spring-wound drive 5 is a tension member and its purpose is to keep the belt 3 continuously under tension. Since the function of the spring-wound drive 1 is to act as the system motive means it has a pulling effect substantially greater than the controlling torque exerted by the tightening spring-wound drive 5.

Figure 2:
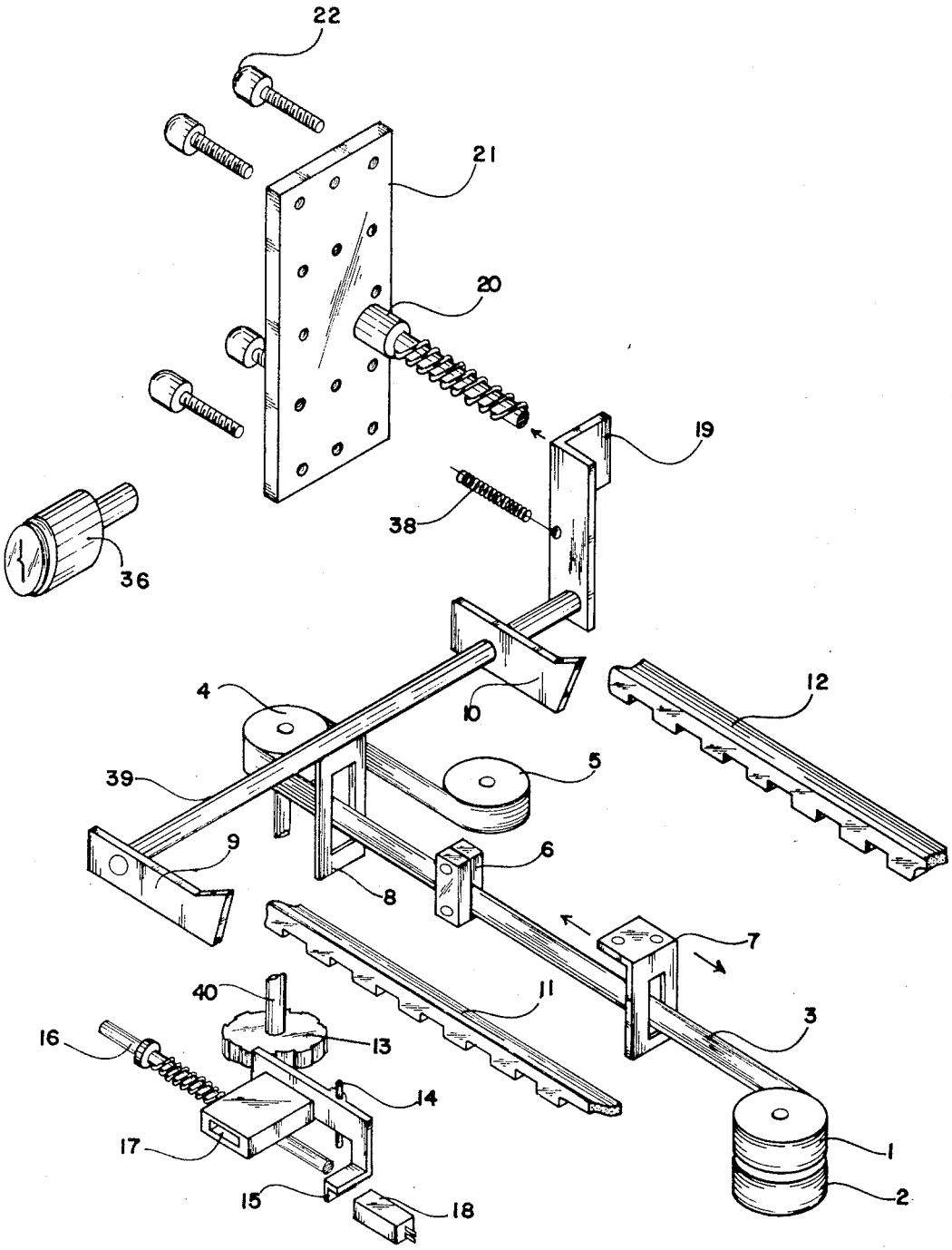
FIG. 2 is a perspective exploded view showing the safety cash box main mechanisms, according to the invention.

The drag block 6 is normally positioned near the drawer's front end. In this normal positon the drag block 6 rests on or against the bearing plate or abutment lug 8 which is rigidly attached to the cross pivot shaft 39 secured at one end thereof to the oscillating bracket 19. The pivot shaft 39 bears, in spaced-apart relationship along its length, the ratchets 9 and 10 which, under the safety-device normal use condition, are kept away from the racks 11 and 12, but which are arranged to engaged with the racks 11 and 12, respectively, in the event that the coil spring 38 urges the bracket 19 to oscillate. The combined slide drawer 26, 27 is provided lengthwise on the underside of its bottom edges with the two parallel rack bars 11 and 12 fixedly attached thereto, and includes, as well, abutment plate 7 vertically depending therefrom. The abutment plate 7 is provided centrally with an opening of suitable size to allow the unobstructed passage of belt 3 therethrough. In the mechanical arrangement generally shown in its normal condition in FIG. 3, when drag block 6 rests at its left-hand (forwardmost) end of its run on the belt 3 and the ratchets 9 and 10 born by the pivot shaft 39 are removed from the respective rack bars 11 and 12, as long as the key lock 36 is kept open, the slide drawer can be fully extended or retracted, without restriction, from or into its housing since the depending abutment plate 7, (FIGS. 2 and 3) rides unrestrictedly lengthwise along belt 3 which freely passes through its central opening.

The rack wheel 13 is freed by taking the pawl 14 provided in the electromagnet armature 17 out of engagement with the cogged wheel. This is accomplished by pushing on the pushbutton 16 which acts on the rear arm 15 laterally extending from the armature 17, or by tractive magnetic action exerted by a conventional electromagnet (not shown) which can be energized by means of a remotely generated electrical signal. As a result, the idler pulley 4, which is rigidly connected to the ratchet-wheel 13 through the shaft 40, will become free, thus suddenly permitting the belt 3 to be wound around the spool of the tractive spring-wound drive 1 without permitting the winding speed to become excessively high, due to the action of the revolution counter device 2 coupled to the spring-wound device 1.

Figure 1:
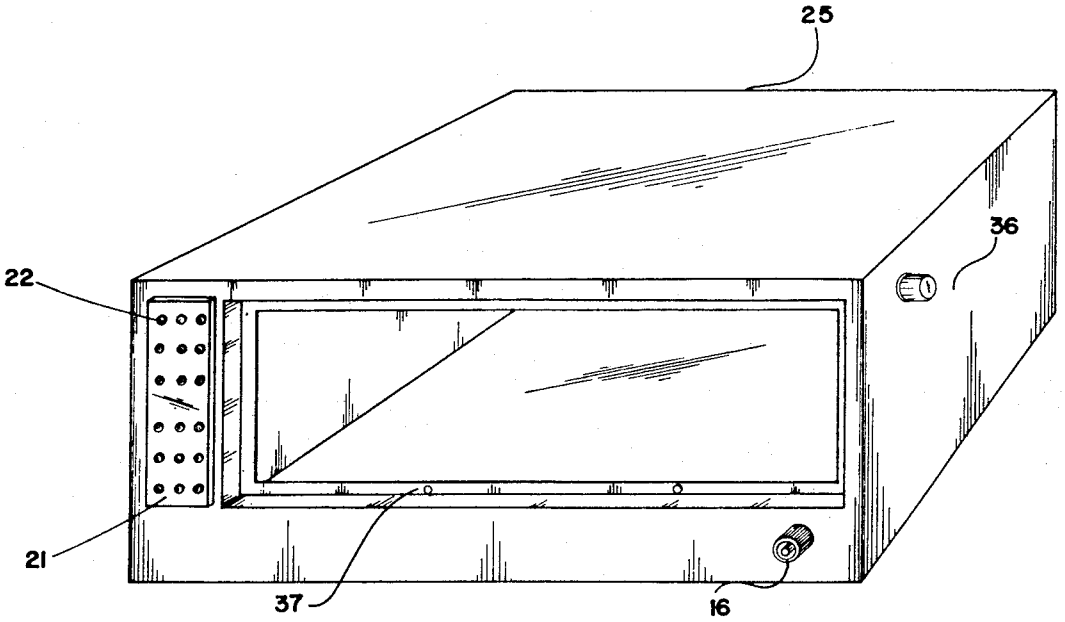
FIG. 1 is a perspective view of the safety cash box housing.

When the belt 3 is wound around the spool, the drag block will travel from its front position resting on the bearing plate to a rear position; immediately after the withdrawal of the drag block 6 from its position resting on the bearing plate 8, the plate is set free, whereupon the ratchets 9 and 10 carried by the pivoting shaft 39 to which the bearing plate 8 is attached engage with the rack bars 11 and 12, respectively. The ratchets are shaped so that even when engaged with the rack bars 11 and 12 the sliding drawer can still enter its housing, but is prevented from coming out. Should the slide drawer be wholly or partially withdrawn from its housing, the drag block 6 will be carried by the belt 3 as the latter is wound about the spool until colliding against the thrust bearing abutment 7 (which depends from the slide-drawer bottom) and thereafter the drawer will be completely pushed by block 6 into its housing. In this manner the drawer is brought into tightly locked condition. In this fully closed position the axial pins 23 are lodged into the bores (FIG. 1). Thus, greater mechanical strength for the front joint between the slide drawer's front fact and the door opening of the body housing it, is provided.

Also provided is a microswitch 18 intended to be connected to the alarm system, and which would concomitantly be acted on when the pawl associated with the armature 14 is shifted out of its engagement position against the rack wheel.

The safety cash box according to the invention, in addition to the slide-drawer locking arrangement just described, is also provided with backup security devices which are actuated if and when mechanical failure in the till-locking mechanisms occurs. Accordingly, should an attempt be made to defeat the safety cash box, when its slide drawer is kept in its irreversibly locked condition by ratchets 9 and 10 engaging with the racks 11 and 12, respectively, or when the drawer has been closed by the key-lock 36, then a high-strength jamming system would be brought into action to cause the drawer to become forcefully wedged in place. It has been mentioned also that the shiftable drawer is made up by combining rear and front sections together. The rear section 26 includes single-panel bottom wall and back-end wall; on the other hand, the front section 27 includes double-panel upright sidewalls and double-panel bottom wall and a front-end wall, so that between each pair of panels facing each other to form the side and bottom walls there is defined a void space. The void space so formed is sized to singly receive therein the marginal leading edges of the bottom wall and sidewalls of the rear section 26. The drawer's two sections 26 and 27 are joined together by the connecting rivets 28, the assembly of parts being such that when the rivets 28 become broken, then the rear section 26 is permitted to telescope to some degree relative to its associated front section 27. Usually, in an attempt to break through the safety box, a pulling force is exerted on the slide-drawer front section 27 which generates a component exceeding the maximum calculated value of shearing strength of the groups of connecting rivets 28. Breaking of the rivets will permit at least a slight forward shift of the drawer front section 27 bringing the slanted surfaces of the double-wedge block 30 into wedge-and-bolt sliding contact with the round-headed bolts 32 and 33. The shank of the bolts 32 and 33 are held in a tight, but sliding, fit within guide sleeves 31 and 34, respectively.

When the double-wedge block 30 is slid toward the left-hand (front) side of the housing as seen in FIG. 3, the wedging action exerted will cause the bolts 32 and 33 to extend downward and upward, respectively, through their respective guide sleeves 31 and 34, whereby their outermost points will be introduced between teeth of the respective top and bottom spur rack bars 24,24 whereupon the drawer jamming effect is attained. To this end, the bolt mechanism just described is made to have high mechanical strength. Further, the double-wedge block 30, because of its width at its major base which is parallel to the bolts 32 and 33, will obstruct the drawer front section, if dragged, from striking against the guiding members 31 and 34.

The mechanism combining the ratchets, bolts and racks would, if the till had not yet reached its final closed position, as for example when in the course of a closing operation carried out in hast under emergency conditions a sheaf of bills became jammed, prevent opening of the drawer any further than where it was stopped when the headlong closing was started.

The double wedge block 30 is able to be shifted forward because it is located opposite the window 29 suitably provided in the respective sidewalls of the slide drawer front section.

In order to open the drawer once it has been made to go into its housing under the action of the automatic-closing motive means, and accordingly has become stuck, the striker device 20 must be pressed to thereby cause the spring-loaded bracket 10 to oscillate against the tension of the coil spring 38. In this manner, as the bracket swings through a limited angle, the pivot shaft 39 attached thereto is correspondingly rotated, and together with the ratchets 9 and 10 is caused to turn in such a way that the ratchets are disengaged from the respective racks 11 and 12.

In order to reach the striker 20 to press thereon, it is necessary to remove the safety front plate 21 (FIG. 2) which requires in turn the removal of the screws 22 or the like securing front plate 21 to the housing body. These operations, on the whole, amount to a hard, time-consuming, toilsome effort requiring the use of special tools.

The key lock 36 installed in the safety cash box housing 25, when pressed, maintains the slide drawer under lock and key, when the latch shaft is thrown into the hole 41 provided in the bridge 35 which is firmly joined to the slide drawer. Register of the latch shaft with the hole 41 provided in the bridge 35 is permitted only when the slide drawer is completely retracted into its housing. In this manner, in order to lock the drawer under lock and key, it is necessary to have the drawer fully retracted.

Different changes and modifications will be apparent to the worker skilled in the art. Therefore, it should be understood that patent protection of the present invention is to be considered limited only by the fair scope of the following claims, and that such claims are to construed as to cover any mechanical equivalents of the subject matter described above.

I claim:

1. A safety cash box having a housing body including respective upright sidewalls and respective spaced apart top and bottom walls, back wall and front opening, and a slidable drawer which in the course of its normal operation is movable back and forth toward retracted and extended positions lengthwise within said housing body, said safety cash box comprising:

slide drawer structure including, a rear drawer section and a front drawer section with said rear and front drawer sections having respective bottom walls and respective upright side walls, said rear and front drawer sections being rigidly joined together by transverse fastening means connecting said respective upright sidewalls of said two drawer sections, wherein said front section is forwardly shiftable respective to said rear section when the breaking down point of said transverse fastening means is exceeded by a force applied to said drawer front section, said slide drawer structure being provided with a thrust bearing member for receiving thereon a backwardly exerted thrust;

motive means including a drawband supporting a thrust applying member thereon, with said motive means being operably coupled through an idler pulley braking means to a trigger device for triggering said motive means, and with said motive means being further operably coupled through said thrust applying member to a locking arrangement for irreversibly locking said slide drawer when the drawer is drawn backward by the action of said thrust applying member against said thrust bearing member, said locking arrangement including respective cooperating rack bars and respective ratchet means, with said rack bars being fixedly joined longitudinally to the underside of the said slide drawer bottom, and said ratchet means being supported on a pivot shaft which is provided with an abutment lug by means of which said pivoting shaft is normally coupled to said thrust applying member of said motive means, said pivot shaft being normally urged by coil spring means which normally act to bring said ratchet means into engagement with said respective rack bars when said thrust applying member ceases to rest on said abutment lug, and jamming means operable in response to said forward shifting of said drawer front section respective to said drawer rear section when said tranverse fastening means are made to break down, said jamming means including, one double wedge block fixedly attached to each of said slide-drawer upright sidewalls and outwardly protruding therefrom, said wedge blocks having slanted surfaces with one of the protruding slanting surfaces of said double wedge blocks facing upward and the other slanting surface directed downward, one set of bolts securely installed on the inner face of each said housing body upright sidewalls, with each of said sets of bolts being comprised of respective upward and downward vertically shiftable locking bolts which are axially extendable when said slanting surfaces are brought into wedge-and-bolt sliding contact when said protruding blocks are forwardly shifted as a result of breakage caused in said transverse fastening means, pairs of vertically distanced apart parallel top and bottom rack bars firmly positioned lengthwise inside said body housing with one pair of said parallel top and bottom rack bars being located in the same vertical plane containing each set of said shiftable bolts, whereby said upwardly and downwardly shiftable bolts are axially extended to make them go into engagement respectively with said top and said bottom rack bars of each pair of rack bars when said double-wedge block slanting surfaces slide to come into wedge-and-bolt sliding contact with said respective axially extendable bolts, thereby causing said slide drawer to become wedged into said housing body when the said transverse fastening means are stressed beyond their breaking down point.

2. A safety cash box as claimed in claim 1, wherein said trigger means operably coupled to said motive means comprises, a pawl-and-ratchet arrangement wherein a common shaft rigidly connects the ratchet wheel to said idler pulley braking means, and said pawl is associated with externally operable means which are operable for taking said pawl away from an engaged position, whereupon said idler pulley is set free to release said drawband whereby said thrust applying member is translated along with the drawband to collide against said thrust bearing member while at the same time said pivot shaft is made to rotate to bring said respective ratchet means into locking position with said respective cooperating rack bars.

3. A safety cash box as claimed in claim 2, wherein said pawl cooperating with said ratchet wheel is associated with the armature of an electromagnetic device whereby said electromagnetic device acts on said pawl to take it away from engagement with said ratchet wheel when an electrical signal from a remote location is applied thereto, whereupon said idler pulley is set free to release said drawband whereby said thrust applying member is moved along said drawband to strike against said thrust bearing member to push said slide drawer back into its housing body, while at the same time said pivot shaft is made to pivot under the pull exerted by said coil spring means to bring said respective ratchet means into irreversible engagement with respective rack bars fixedly joined to the underside of the bottom of said slide drawer.

4. The safety cash box as claimed in claim 1 wherein said front section includes a double-panel bottom and double-panel upright walls, the panels of each pair of panels facing each other being spaced apart so that a void space is defined therebetween, and a cutaway portion in each of said double-panel side walls is arranged to provide therein respective openings through which respective slanting surfaces of said double-wedge block protrude outwardly of said side walls, said rear section includes a single-panel bottom and single-panel upright side walls with the marginal leading edges thereof being snugly fitted into said void space provided between said spaced apart panels forming said front section structure, and said transverse fastening means having a predetermined maximum shear strength which when surpassed by a shear stress lengthwise applied on said slide drawer front section causes said transverse fastening means to yield whereby said double-wedge blocks are shifted forward along with said front section to engage their outwardly protruding slanting surfaces against said sets of shiftable locking bolts thereby causing said bolts to be axially extended into engagement with said parallel top and bottom rack bars.

* * * * *